US008985363B2

(12) United States Patent
Gubitosi et al.

(10) Patent No.: US 8,985,363 B2
(45) Date of Patent: Mar. 24, 2015

(54) FOOD/DRINK CONTAINER

(71) Applicant: Mattel, Inc., El Segundo, CA (US)

(72) Inventors: Domenic T. Gubitosi, East Aurora, NY (US); David Shapiro, East Aurora, NY (US); Charlie Smith, East Amherst, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/021,311

(22) Filed: Sep. 9, 2013

(65) Prior Publication Data

US 2014/0069887 A1 Mar. 13, 2014

Related U.S. Application Data

(60) Provisional application No. 61/699,022, filed on Sep. 10, 2012.

(51) Int. Cl.

| | |
|---|---|
| ***B65D 25/28*** | (2006.01) |
| ***A47G 19/12*** | (2006.01) |
| ***A45C 11/20*** | (2006.01) |
| ***A47G 19/30*** | (2006.01) |

(52) U.S. Cl.

CPC ..... *B65D 25/2867* (2013.01); *A47G 19/12* (2013.01); *A45C 11/20* (2013.01); *A47G 19/30* (2013.01)

USPC ..... 215/397; 220/212.5; 220/229; 220/710.5; 220/752; 220/755; 220/757; 220/758; 220/762; 220/765; 215/370; 215/376; 206/366; 206/370; 222/111

(58) Field of Classification Search

CPC .... B65D 25/28; B65D 25/2867; A45C 11/20; A47G 19/12; A47G 19/30

USPC ..... 220/212.5, 229, 710.5, 752, 755, 757, 220/758, 762, 765; 215/370, 376, 397; 206/366, 370; 222/111

See application file for complete search history.

(56) References Cited

U.S. PATENT DOCUMENTS

| | | | | |
|---|---|---|---|---|
| 1,983,139 | A | | 12/1934 | Lovell |
| 3,061,080 | A | | 10/1962 | Stephen |
| 3,478,922 | A | | 11/1969 | Mole |
| 4,328,904 | A | * | 5/1982 | Iverson ..... 220/229 |
| 4,600,112 | A | | 7/1986 | Shillington et al. |
| 4,884,717 | A | | 12/1989 | Bussard et al. |
| 5,050,760 | A | | 9/1991 | Garcia |

(Continued)

FOREIGN PATENT DOCUMENTS

| | | | |
|---|---|---|---|
| JP | 2004329296 | A | 11/2004 |
| JP | 2006008187 | A | 1/2006 |
| KR | 1019980081032 | A | 11/1998 |

OTHER PUBLICATIONS

International Search Report PCT/US2013/058974, dated Dec. 13, 2013.

*Primary Examiner* — Elizabeth Volz

(74) *Attorney, Agent, or Firm* — Edell, Shapiro & Finnan, LLC

(57) ABSTRACT

A food/drink container includes a receptacle, a lid removably secured to the receptacle and a handle movably coupled to the container such that the handle may move between a first configuration and a second configuration. In the first configuration, at least a portion the handle is disposed below the receptacle and in the second configuration, at least a portion of the handle is rotatable with respect to receptacle.

18 Claims, 6 Drawing Sheets

(56) References Cited

U.S. PATENT DOCUMENTS

| | | | | |
|---|---|---|---|---|
| 6,269,949 | B1 * | 8/2001 | Gottlieb | 206/519 |
| 6,656,514 | B1 | 12/2003 | Tubbs | |
| 6,843,387 | B2 | 1/2005 | Karaki et al. | |
| 6,986,433 | B2 | 1/2006 | Colford et al. | |
| 7,396,176 | B2 | 7/2008 | Schoemer | |
| 7,591,388 | B2 | 9/2009 | Amormino | |
| 7,766,168 | B2 | 8/2010 | Thrapp et al. | |
| 7,770,748 | B2 | 8/2010 | Elliott | |
| 2003/0062366 | A1 | 4/2003 | Moss | |
| 2005/0252923 | A1 | 11/2005 | Woolf | |
| 2005/0263523 | A1 | 12/2005 | Moss | |
| 2013/0098933 | A1 * | 4/2013 | Del Solar et al. | 220/810 |

* cited by examiner

FOOD/DRINK CONTAINER

CROSS-REFERENCE TO RELATED APPLICATION

This application claims priority to and is based on U.S. Patent Application No. 61/699,022, filed Sep. 10, 2012, entitled "Food/Drink Container," the entire disclosure of which is incorporated herein by reference in its entirety.

FIELD OF THE INVENTION

The present invention relates to a food container. More specifically, the present invention relates to a snacker with a repositionable handle.

BACKGROUND OF THE INVENTION

Many developing young children do not eat large meals, but instead, frequently snack or eat small meals throughout the day. However, young children may not always have the coordination and motor skills to neatly eat and carry a snack. In order to overcome this problem, many snackers (snack containers) with flexible lids have been introduced. The lids can retain food within a container while also allowing a child to access the food when he or she desires a snack. This solution keeps the majority of a snack contained, as well as protected, while still allowing the child to hold the entire snack.

Further, many snackers have included handles to allow a child to easily carry or tote a snacker along wherever he or she goes. However, many of these handles serve as obstacles when a child is attempting to access snacks stored in the snacker. These handles may also prevent a snacker from sitting flat on a support surface when a child wants to put the snacker down on a support surface. Thus, a snacker, or any receptacle for food or drink, with a repositionable handle is desired.

SUMMARY OF THE INVENTION

According to at least one exemplary embodiment of the present invention, a food or drink container includes a container including an interior cavity, a lid, and a handle movably coupled to the container. The lid is removably securable to the container and includes at least one opening such that the interior cavity may be accessed via the at least one opening when the lid is secured to the container. The handle is rotatable between a first configuration and a second configuration, at least a portion of the handle being disposed beneath the container and secured thereto in the first configuration and the handle being rotatably coupled to the container in the second configuration.

BRIEF DESCRIPTION OF THE DRAWINGS

Like reference numerals have been used to identify like elements throughout this disclosure.

DETAILED DESCRIPTION OF THE INVENTION

Figure 1:
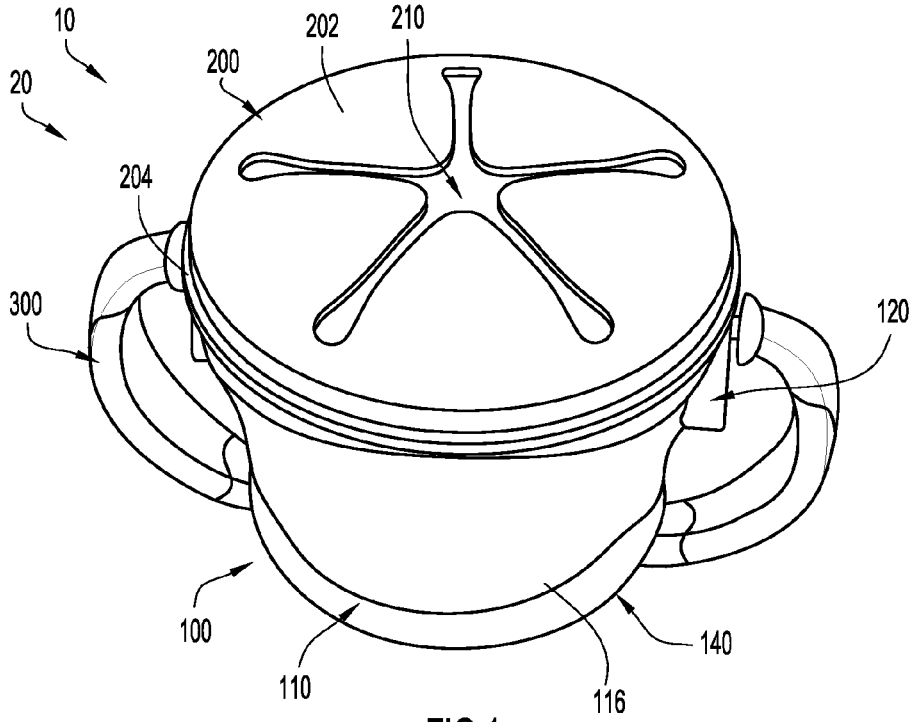
FIG. 1 shows a front view of an exemplary embodiment of a food container in accordance with the present invention in a first configuration.

Generally referring to FIGS. 1-7, at least one exemplary embodiment of a food/drink container in accordance with the present invention is shown. Generally, food/drink container 10 includes a receptacle 100, a lid 200, and a handle 300. As will be described in detail below, the handle 300 is repositionable in at least two configurations, a first configuration 20 and a second configuration 30 (shown in FIG. 6E), such that at least a portion the handle 300 is disposed below the receptacle 100 in the first configuration 20 and at least a portion of the handle 300 is disposed above the receptacle 100 in the second configuration 30. In some embodiments, at least a portion of the handle 300 is also rotatable with respect to receptacle 100 when disposed in the second configuration 30. Regardless of the configuration that the container 10 is disposed in, handle 300 may provide a handle or handles for the container 10 to be carried by.

Referring now to FIG. 1, container 10 includes a lid 200 that is selectively coupleable to a receptacle 100. The lid 200 includes a top 202 and a skirt or wall 204 extending downwards around the periphery of the top 202. The top 202 may be any desirable shape, but is shown as a substantially circular top 202. Lid 200 may also include a feature or mechanism which allows lid 200 to be securely coupled to receptacle 100. For example, in some embodiments, lid 200 may include threads on the internal surface of wall 204 which may be configured to thread onto a matching surface included on receptacle 100. Furthermore, lid 200 includes an opening 210 which may partition, split, bisect, or otherwise separate the top 202 of lid 200 into multiple segments such that a child may access an interior compartment 118 (see FIG. 2) of receptacle 100 through opening 210. In some embodiments, the top 202 (including opening 210) and skirt 204 may be formed individually and coupled together, but in other embodiments, the lid 200 may be formed integrally.

Figure 2:
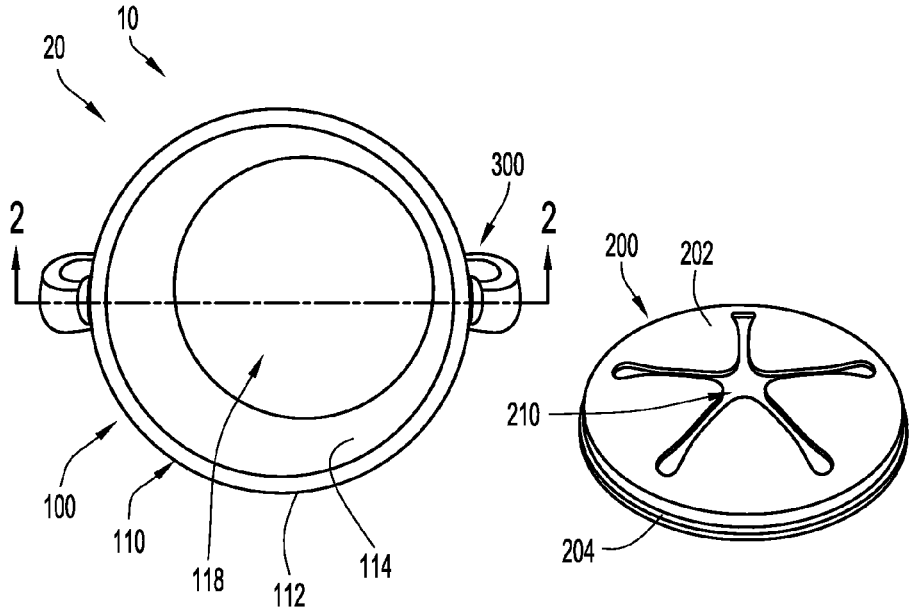
FIG. 2 shows a top view of the embodiment of FIG. 1 with the handle in a first configuration and the lid removed from the container.

Now referring to FIG. 2, with continued reference to FIG. 1, receptacle 100 may include a wall 110 that may be coupled to or formed with a bottom 140, such that, together, wall 110 and bottom 140 may form interior region or compartment 118. The wall 110 may be substantially circular and may have an exterior surface 116 and an interior surface 114 which meet at a top edge 112 such that wall 110 has some thickness. Thus, in some embodiments, at least a portion of handles 300 may be received within wall 110. However, as seen in FIG. 1, receptacle 100 also includes bosses 120, which may alternatively be referred to as receivers or handle engagement portions, coupled to or formed with exterior wall 110, in order to facilitate the reception of handle 300 and the movement of handle 300 between the first configuration 20 and the second configuration 30. Thus, in some embodiments, the handle 300 may be coupled to receptacle 100 via bosses 120, such that the interior surface 114 of wall 110 does not include any openings or protrusions. Such a configuration eliminates any safety hazards from the interior compartment 118 and may also make the container 10 easier to clean. Additionally, and as mentioned above, receptacle 100 may include a feature or mechanism which facilitates coupling of the lid 200 to receptacle 100. For example, edge 112 or a portion of wall 110 proximate to edge 112 may be threaded or configured to receive threads such that receptacle 100 and lid 200 may be threadably engaged.

Figure 3:
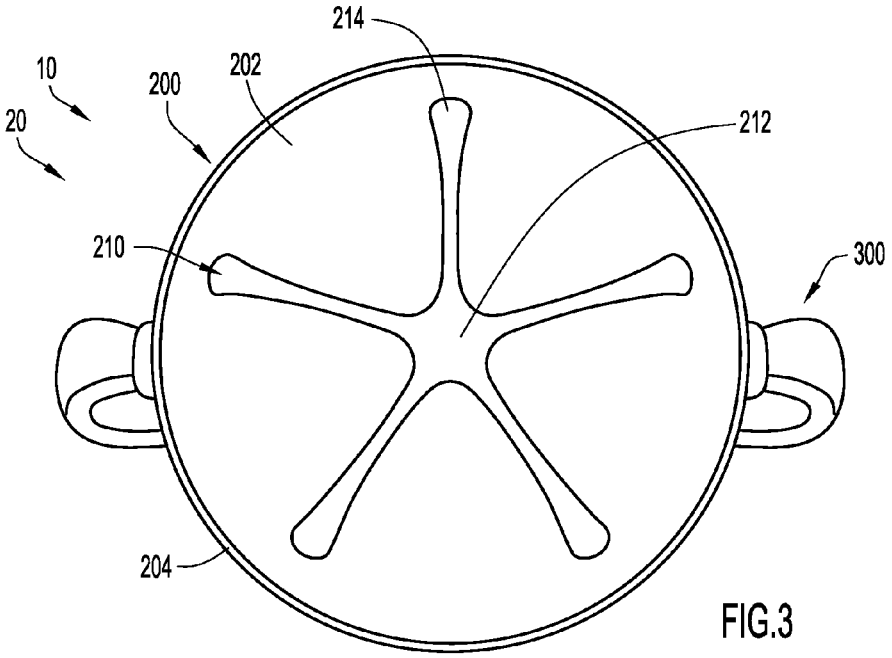
FIG. 3 shows a top perspective view of the embodiment of FIG. 1 in the first configuration.

Turning now to FIG. 3, the container 10 is shown from a top view. As mentioned above, lid 200 includes an opening 210. In some exemplary embodiments, such as the embodiment shown in FIG. 3, opening 210 includes a central opening or hub 212 connected to any desirable number of slits 214, which may also be referred to as spokes, exterior openings, or some combination thereof. However, it is to be understood that the term "central" is only used to denote that slits 214 extend outwardly from central opening 212 and the central opening 212 may be disposed in any desirable location on lid 200. In FIG. 3, five slits 214 extend outwardly from central opening 212 such that opening 210 resembles a star or asterisk, however, in other embodiments, any desirable number of slits 214 may be included which allow lid 200 to function in accordance with the scope of this invention (where a child can use her hand to deform the slits 214 of the soft lid 200 to reach the food stored in the receptacle 100). Similarly, each slit 214 may extend outwardly for any desirable length which allows lid 200 to function in accordance with the scope of this invention. Furthermore, in FIG. 3, central opening 212 is shaped substantially as a pentagon, but it is to be understood that central opening 212 may be any desirable shape or size which allows lid 200 to function in accordance with the scope of this invention. Alternatively, in other embodiments, the lid 200 may simply include slits 214 which extend across the lid 200, such that the lid does not include a central opening.

Figure 4:
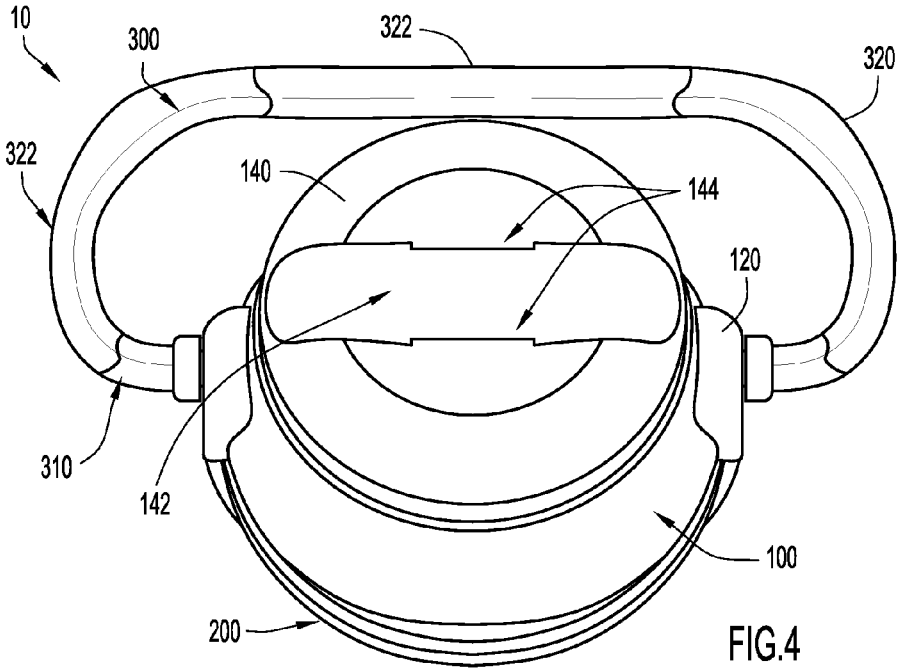
FIG. 4 shows a bottom perspective view of another embodiment of a food container in accordance with the present invention.

Now referring to FIG. 4, container 10 is shown from a bottom perspective view in between the first and second configurations. As shown in FIG. 4, bottom 140 includes a channel or elongated cavity 142 that extends across bottom 140. Channel 142 is sized to receive handle 300 therein when the container 10 is in the first configuration 20. Channel 142 may also include fingers or resilient members 144 to removably secure handle 300 within channel 142. However, in other embodiments, the channel 142 may include any desirable feature configured to removably secure the handle 300 within channel 142.

Also as shown in FIG. 4, handle 300 may include a grippable portion 320 and inserts 310 formed on both ends of the grippable portion 320. As will be addressed in detail below, each insert 310 may be received within a boss 120 which allows the insert 310 limited range of movement such that handle 300 may move between the first configuration 20 and the second configuration 30. Additionally, the grippable portion 320 may include multiple grips 322 that may be made from a soft polymer and overmolded onto or coupled to the grippable portion 320 which, in contrast, may be formed from a more rigid material, such as TPE or other plastics. However, in other embodiments, grips 322 may be formed integrally with grippable portion 320 and/or may simply be colored or patterned portions of grippable portion 320.

Figure 5:
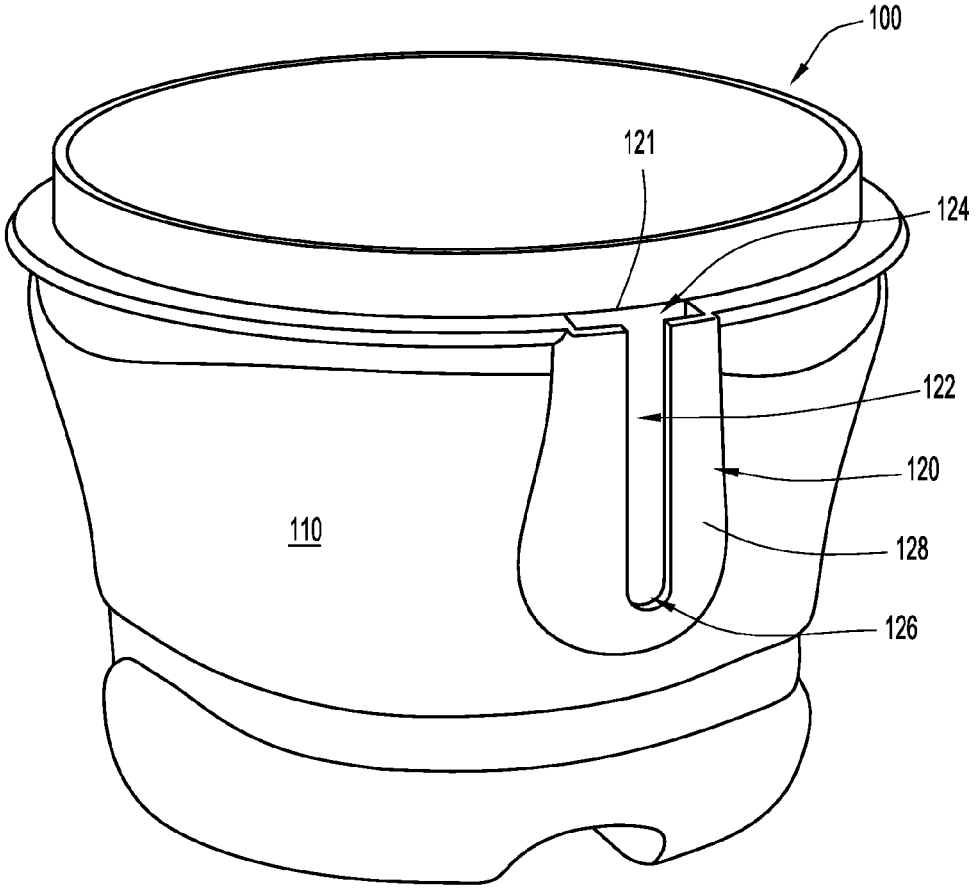
FIG. 5 shows a front perspective view of a portion of the embodiment of FIG. 4 with the handle removed).

Referring now to FIG. 5, the receptacle 100 of container 10 is shown from a perspective view without the handle 300 and lid 200, such that boss 120 may be clearly shown. As shown, each boss 120 includes an opening 122 that extends from a first end 124 to a second end 126 and a raised flange 128 that substantially surrounds the opening 122. In some embodiments, the flange 128 may extend directly from wall 110, but in this embodiment, the boss 120 also includes an interior portion 121 that is coupled to the wall 110 and the flange 128 extends from portion 121. Regardless of where the flange extends from, the opening 122 may extend, at least to a certain extent, underneath a portion of the flange 128, such that a piece or part of insert 310 may be secured between the wall 110 (either directly or via interior portion 121) and a portion of the flange 128. The lid 200 closes off the top end of opening 122 to capture the handle 300 therein. When the lid 200 is removed, the handle 300 may be removed from opening 122 for cleaning.

Generally, the aforementioned features and structure allow the container 10 to be selectively positioned in either a first configuration 20 or a second configuration 30. Accordingly, in FIGS. 6A-E, the container is shown being moved from the first configuration 20 to the second configuration 30. In particular, in FIGS. 6A-B, the container 10 is shown in the first configuration 20, in FIGS. 6C-D, the container 10 is shown between the first configuration 20 and the second configuration 30, and in FIG. 6E, the container 10 is shown in the second configuration 30.

Notably, as shown in FIGS. 6A-E and as will be described in more detail below, when the container is in either the first configuration 20 or the second configuration 30, the inserts 310 of handle 300 may both be disposed adjacent to the first end 124 of the opening 122. In contrast, when the handle 300 is moving between configurations 20 and 30, the inserts 310 may move adjacent to the second end 126 of opening 122, at least for a portion of this movement. As will be explained in more detail below, such movement provides the necessary range of motion to allow the handle to move between the desired first and second configurations 20 and 30. If container 10 did not include features which allowed this movement, handle 300 would need to either be decoupled from receptacle 100 or be bent around bottom 140 in order to allow for movement between configurations 20 and 30. Accordingly, the features of container 10 allow a stiff, robust, handle, which is easy for a child to carry and manipulate, to be repositioned between configurations 20 and 30.

Figure 6A:
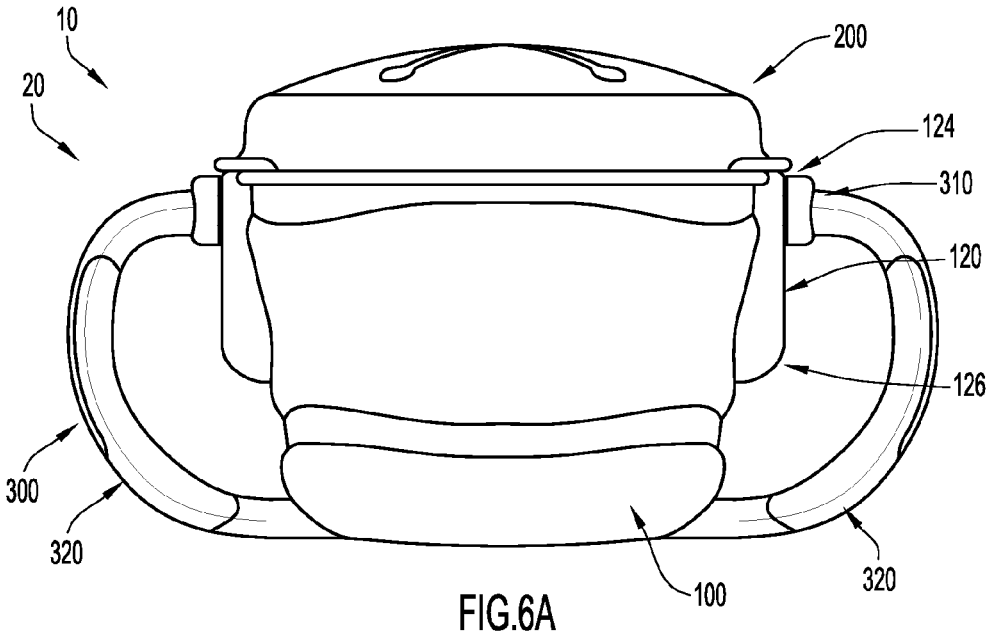
FIGS. 6A-B show front and bottom perspective views of the embodiment of FIG. 1 in a first configuration.
Figure 6B:
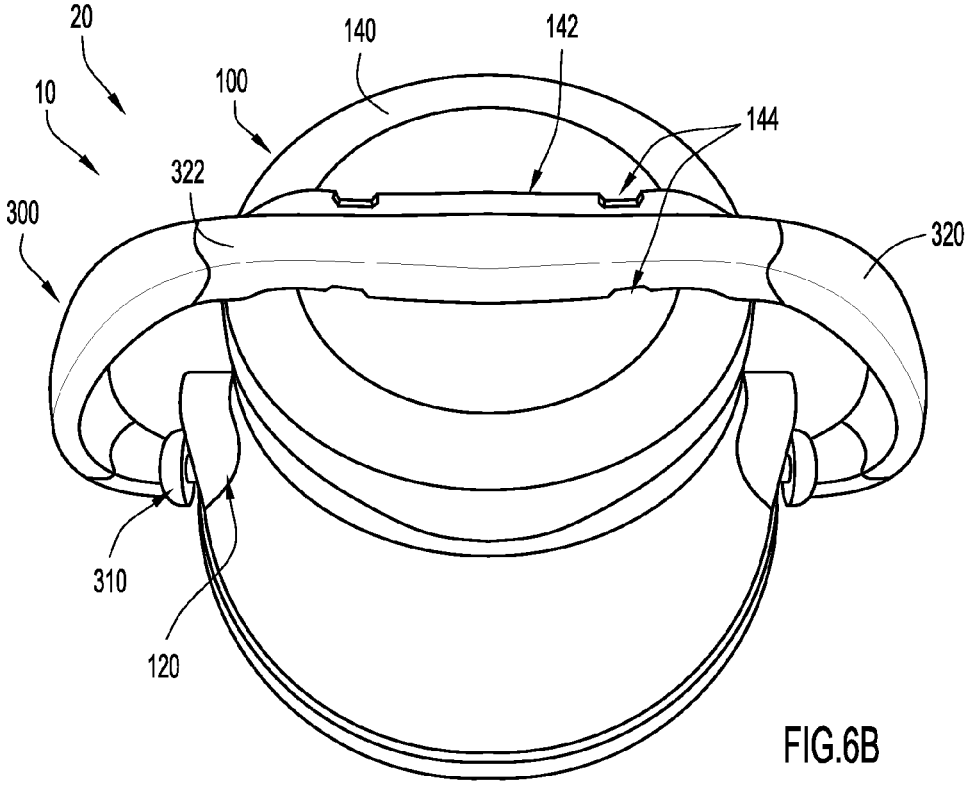

Now referring specifically to FIGS. 6A-6B, when handle 300 is positioned in the first configuration 20, a portion of handle 300 is disposed substantially within bottom 140 (via channel 142), such that bottom 140 may sit flat on a supporting surface even with handle 300 disposed therein. In the particular embodiment shown in FIGS. 6A-6B, the handle 300 is removably secured within channel 142 by a set of resilient fingers 144. Furthermore, as seen in FIG. 6A, when handle 300 is disposed in the first configuration 20, handle 300 may be appear to be two separate side-mounted handles. However, in actuality, the grippable portion 320 may simply be presented on two sides of receptacle 100 while a central section of grippable portion 320 is secured within channel 142. Consequently, the handles 300 may be fixed with respect to the receptacle 100 in the first configuration 20. In this embodiment the handles are fixed laterally exterior of the receptacle 100.

Figure 6C:
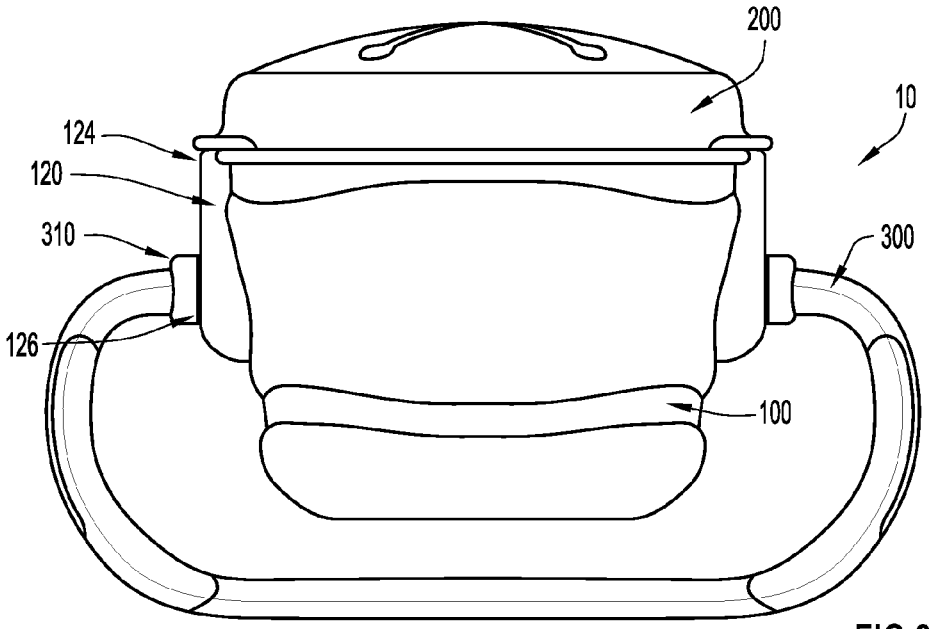
FIGS. 6C-D show front and side perspective views of the embodiment of FIG. 4 in between a first configuration and a second configuration
Figure 6D:
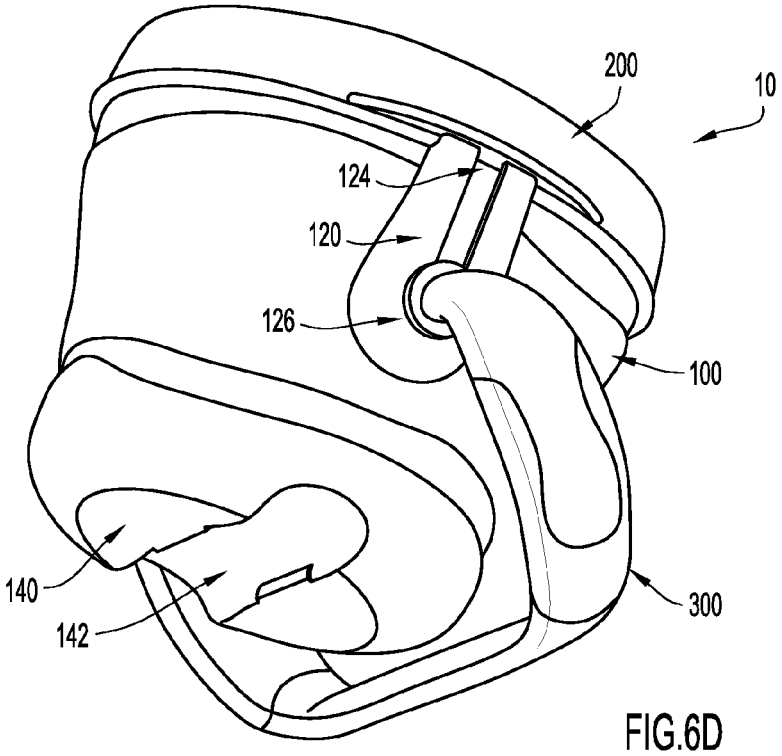

Now referring to FIGS. 6C-D, in order to move the handle 300 to the second configuration 30, the handle 300 must be removed from the channel 142. In order to effectuate this removal, the inserts 310 can slide from the first end 124 of the openings 122 towards the second end 126, such as to the position shown in FIG. 6C. Then, when disposed proximate to or adjacent to the second end 126, the handle 300 may be rotated, either clockwise or counter-clockwise, as desired, in order to clear the edges of bottom 140. In other words, the handle 300 may rotate around the edges of bottom 140 without contacting the bottom 140 when the inserts 310 are disposed adjacent second end 126. After the handle clears bottom 140, it may be rotated to a position above container 10, at which point the inserts 310 may move back to a position adjacent to the first end 124, perhaps due to the upwards force exerted on the handle 300 while rotating it, or due to gravitational forces exerted on the receptacle 100, allowing the container to move to its second configuration 30.

Figure 6E:
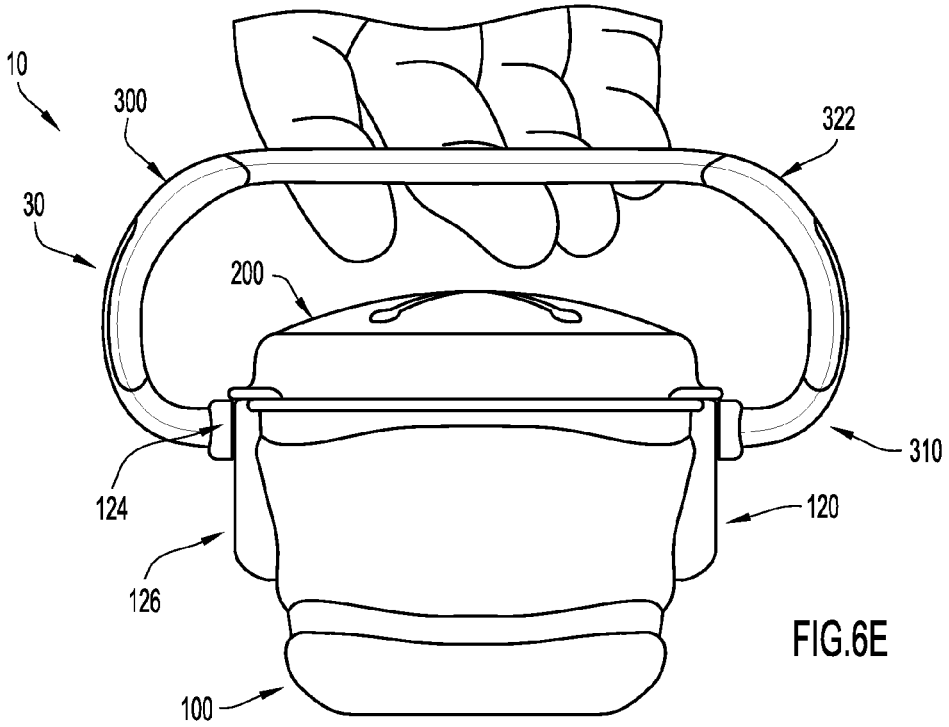
FIG. 6E shows a front perspective view of the embodiment of FIG. 1 in a second configuration.

Referring now to FIG. 6E, the receptacle 100 of the food container 10 is shown in the second configuration 30. When in the second configuration 30, the entire grippable portion 320 is available to hold, as opposed to only the two side portions that are available when the container 10 is in the first configuration 20. As mentioned above, when oriented in the second configuration, at least a portion of handle 300 may be rotatable with respect to receptacle 100. More specifically, in some embodiments, when container 10 is in the second configuration 30, no parts or portions of grippable portion 320 are locked or secured in place and, thus, the handle 300 may be free to move within bosses 120 and/or rotate about an axis substantially parallel with inserts 310 as desired. However, in other embodiments, each boss 120 may include a detent or a similar feature or mechanism to secure the handle 300 in a desirable rotational position when in its second configuration. In still other embodiments, the boss 120 may include a detent or a similar feature or mechanism to secure the up and down linear movement of the inserts 310 with respect to the receptacle 100 while still allowing rotational movement.

Referring generally to FIGS. 6A-E, in order to move the container 10 back from the second configuration 30 to the first configuration 20, the same steps are taken in reverse. More specifically, first, each insert 310 is moved far enough towards end 126 so that handle 300 can rotate around wall 110 and bottom 140 without contacting these parts. Once handle 300 is disposed beneath bottom 140, the handle may be moved into channel 142 as each insert 310 moves back towards the first end 124 of opening 122.

Figure 7:
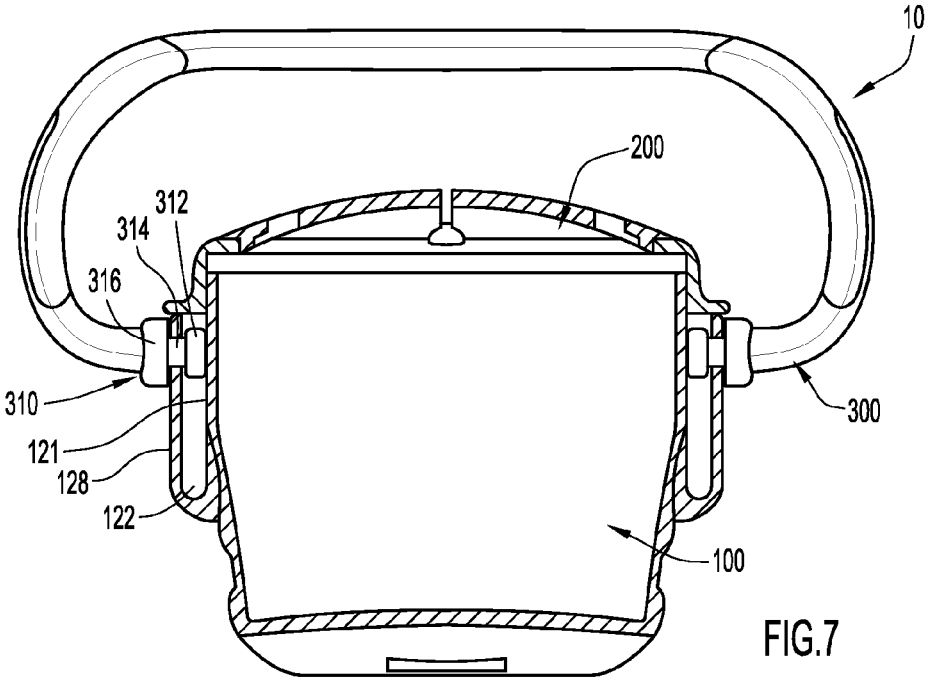
FIG. 7 shows a cross-sectional view of the embodiment of FIG. 6E, taken along line 2-2 shown in FIG. 2, in the second configuration.

Now turning to FIG. 7, a cross-sectional view of the container 10 is shown along line 2-2 from FIG. 2. This view highlights the interplay between inserts 310 and bosses 120. In the exemplary embodiment shown in FIG. 7, insert 310 includes an enlarged portion 312 (similar to the head of a screw) that sits within boss 120 and extends laterally across opening 122 such that opposite sides of the enlarged portion 312 are each trapped between portions of flange 128 and the interior portion 121 of boss 120. In this exemplary embodiment, insert 310 also includes a neck portion 314 extending both outwardly from the enlarged portion with respect to container 10 and between a collar 316. Together, the enlarged portion 312, neck 314, and collar 316, allow insert 310 to slide longitudinally in opening 122 between the first end 124 and the second end 126, but prevent or greatly deter insert 310 from exiting or being removed from boss 120 when the lid 200 closes the top of the opening 122.

As briefly mentioned above, in some embodiments, boss 120 may include a feature or mechanism to selectively secure handle 300, by way of securing insert 310, in a specific position. For example, in some embodiments, boss 120 may include resilient fingers or a detent so that insert 310 may be secured adjacent to first end 124. However, the fingers may simply restrict one degree of movement, such as movement in the vertical axis (with movement in the horizontal axis already being restricted by boss 120) so that handle 300 may still rotate freely. In other words, the fingers, or other securing mechanism or feature, may simply fix the axis of rotation that handle 300 may rotate about without restricting rotational movement of handle 300.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A container comprising:

a receptacle including an interior cavity;

a lid removably securable to the receptacle and including at least one opening such that the interior cavity may be accessed via the at least one opening when the lid is secured to the receptacle;

a handle movably coupled to the container, the handle being rotatable between a first configuration and a second configuration, at least a portion of the handle being secured beneath the receptacle in the first configuration and the handle being rotatably coupled to the receptacle in the second configuration; and a channel disposed beneath the receptacle, the channel being configured to releasably secure the portion of the handle beneath the receptacle in the first configuration.

2. The container of claim 1, wherein the channel includes at least one resilient finger configured to releasably secure the handle in its first configuration.

3. The container of claim 1, wherein the channel is sized to receive the handle in a manner which allows the receptacle to sit flat on a support surface when the handle is secured within the channel.

4. The container of claim 1, wherein the handle provides two grippable portions when in its first configuration and a single grippable portion when it is second configuration.

5. The container of claim 4, wherein the two grippable portions are fixed laterally exterior of the receptacle and the single grippable portion is rotatable with respect to the receptacle such that it may be disposed above the receptacle.

6. The container of claim 1, wherein the receptacle includes an inner surface, an outer surface, and at least one receiver disposed on the outer surface, the at least one receiver configured to movably couple the handle to the receptacle.

7. The container of claim 6, wherein the handle extends from a first end to a second end and includes an insert on each of the first and second end, each insert being configured to be slidably received within one of the at least one receiver.

8. The container of claim 7, wherein each receiver includes a first end and a second end, the insert being adjacent to the first end when the handle is in the first configuration or the second configuration and the insert sliding towards the second end when the handle is moved between the first and second configurations.

9. A children's food container comprising:

a receptacle including an interior cavity;

a lid removably securable to the receptacle and including at least one opening such that the interior cavity may be accessed via the at least one opening when the lid is secured to the receptacle; and a handle movably coupled to the container, the handle being rotatable between a first configuration and a second configuration, the handle providing two grippable portions when in its first configuration and a single grippable portion when in its second configuration.

10. The children's food container of claim 9 wherein the receptacle is configured to sit flat on a support surface in both the first and the second configurations.

11. The children's food container of claim 9, wherein the handle is rotatable in its second configuration and prevented from rotating in its first configuration.

12. The children's food container of claim 9, wherein the receptacle includes at least one receiver, the at least one receiver configured to movably couple the handle to the receptacle and each one of the at least one receiver is configured to allow the handle to only move longitudinally and rotationally with respect to the receptacle.

13. The children's food container of claim 9, further comprising:

a channel, the channel being disposed beneath the receptacle and being configured to releasably secure the handle therein.

14. The children's food container of claim 13, wherein at least a portion of the handle is secured within the channel in the first configuration and the handle is not secured within the channel in the second configuration.

15. A children's food container comprising:

a receptacle including:

an interior cavity; and at least two handle engagement portions;

a lid removably securable to the receptacle and including at least one opening such that the interior cavity may be accessed via the at least one opening when the lid is secured to the receptacle;

a handle movably engaged with the at least two handle engagement portions, the handle being rotatable between a first configuration and a second configuration, at least a portion of the handle being disposed beneath the receptacle and secured thereto in the first configuration and at least a portion of the handle being disposed above the receptacle in the second configuration; and a channel disposed beneath the receptacle, the channel being configured to releasably secure the portion of the handle beneath the receptacle in the first configuration.

16. The children's food container of claim 15, wherein each of the at least two handle engagement portions is configured to restrict latitudinal movement of the handle with respect to the receptacle.

17. The children's food container of claim 15, wherein the handle is configured to move between the first and second configurations without being decoupled from the receptacle.

18. The snacker of claim 17, wherein the handle is substantially rigid.

* * * * *